US006110058A

United States Patent [19]

Bennett

[11] Patent Number: 6,110,058

[45] Date of Patent: Aug. 29, 2000

[54] GOLF BALL STRUCTURED PRIMARILY FOR PUTTING

[76] Inventor: John E. Bennett, 1570 Homewood Dr., Altadena, Calif. 91001

[21] Appl. No.: 09/317,835

[22] Filed: May 25, 1999

[51] Int. Cl.[7] ..... A63B 37/00

[52] U.S. Cl. ..... 473/351; 473/359

[58] Field of Search ..... 473/383, 384, 473/358, 359

[56] References Cited

U.S. PATENT DOCUMENTS

| | | | |
|---|---|---|---|
| Re. 25,427 | 7/1963 | Harkins | 473/359 |
| 1,568,514 | 1/1926 | Lewis | 473/358 X |
| 3,796,435 | 3/1974 | Dale | 473/200 |
| 4,346,898 | 8/1982 | Badke | 473/384 |
| 5,888,150 | 3/1999 | Young | 473/383 X |

*Primary Examiner*—Jeanette Chapman
*Assistant Examiner*—M. Chambers

[57] ABSTRACT

Conventional golf balls are engineered according to aerodynamic specifications, basically to perform in flight. These balls are not suitable for the terrain of the grass. No consideration has been given to make conventional golf balls putting compatible. Conventional balls are aerodynamic and the improved golf ball for putting, presented in this invention, is a "Terradynamic Ball". This invention provides a ball engineered primarily for putting and is accomplished by giving the ball more inertia and power and by decreasing friction and resistance. It is designed according to the Laws of Motion, which states that, "Every body continues in its state of rest, or motion in a straight line, unless it is compelled by some external force to change that state". This "Terradynamic Ball" comprises a heavy metal core, to provide greater inertia, and a lower center of mass, and a cover whose outer surface is uniformly even and smooth, minimizing friction rolling over grass. These factors, working together, in combination, develope greater stability in the rolling ball, and, consequently, create a greater accuracy in putting.

5 Claims, 1 Drawing Sheet

CROSSECTION OF THE PUTTING BALL

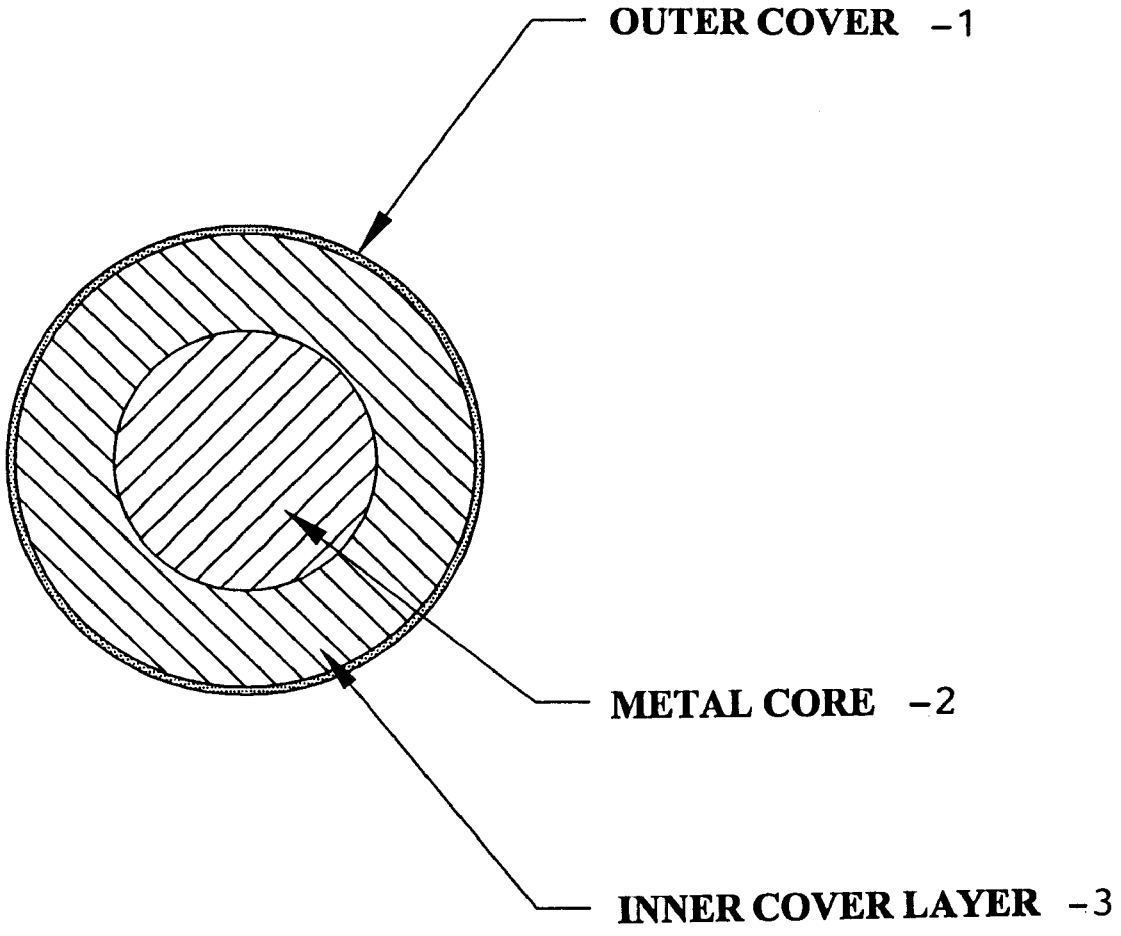
CROSSECTION OF THE PUTTING BALL

GOLF BALL STRUCTURED PRIMARILY FOR PUTTING

FIELD OF THE INVENTION

Game of golf accessories.

BACKGROUND OF THE INVENTION

This invention relates to an Improved Golf Ball structured primarily for the putting aspect of the golf game.

The game of golf has consumed the weekends and passions of millions of people worldwide for many years, and increasingly so in recent years as its popularity has soared. The reasons for its popularity are legion, and include the beautiful settings in which it is played, the opportunity for leisurely exercise, companionship, and the elusive satisfaction of successfully navigating a small white ball several hundred yards from a golf tee into a small hole, using just a few strokes of a golf club.

While many people spend a great deal of time perfecting their tee shots, hoping to add distance to their drives, it is the putting stroke which usually determines the ultimate success of a golfer. Putting is an uncertain, uncontrolled, and intimidating demand in the game of golf. The reward from putting is often inconsistent with the overall skill and efforts of the player.

Conventional golf balls are engineered for flight, distance, spin and special feel and impact effect. Current balls are designed for their aerodynamic characteristics. They are great for that. But what about putting? They are not designed or engineered for putting. They are not truely putting compatable.

In using this "aerodyanmic" ball on the "green" for putting, certain difficulties arise due to its light weight and sculptured designs and dimples on the cover. The grass interacts with the rolling ball. The blades of grass catching on the edges of the high spots of the dimples, have a tendency to significantly divert and detour the rolling ball.

The player has no control or recourse to the interaction of the grass with the moving ball. The player spends a great deal of time and mental energy assessing the possible course the ball will take to arrive at the hole. The player strokes the ball and holds his breath, hoping the ball will get in the cup. Good luck. Most of the time the ball will move at the discretion of the grass, and not usually, where the player had planned it. Putting is the big flaw in the golf game. It is an arbitrary imposition on the player, requiring him to accomplish something over which he has no full control. Thus, the player is often punished over something he could not avoid. Putting should be directly commensurate with the player's skill.

BRIEF SUMMARY OF THE INVENTION

Conventional golf balls are engineered according to aerodynamic specifications, basically to perform in flight. These are not suitable to roll on the terrain of the grass. No consideration has been given to make conventional golf balls putting compatible. The improved ball, presented herewith, is engineered to roll on the grass with more determined accuracy and controll. In contrast to the aerodynamic ball, this Ball is called, "Terradynamic Ball".

It is designed according to the laws of motion as applicable to a golf ball rolling on textured grass. The Law of Motion states that, "Every body continues in its state of rest, or motion in a straight line, unless it is compelled by some external force to change that state". This law can be stated in another way: "Inertia is that property which enables a body of matter, (ball) to oppose any change in its motion, whether that change be one of speed or direction".

So, the greater the inertia, the more determined is the ball to hold to its direction and to stay on course. In addition, if resistance and friction are reduced on the rolling ball, the performance of the ball can further be improved.

To comply with the Law of Motion, this improved ball for putting, is comprised of two basic features or claims which diststinguish it from other golf balls. First, it has a heavier core which is made of metal. Thus it has mass or weight concentrated at its center. This creates greater inertia in the rolling ball. The second unique feature or claim, is that this ball rolls with less friction and resistance. This is accomplished in the "Terradynamic Ball", the invention presented herein, by incorporating a "uniformly even and smooth surface" on the ball's cover. This is in contrast to the conventional balls, which have structured "dimples" on the surface of the cover. These dimples interact with the blades of the grass and the ball is accordingly diverted as it rolls.

BRIEF DESCRIPTION OF THE DRAWINGS

FIG. 1 is a crosssection view of the golf ball.

DETAILED DESCRIPTION OF THE INVENTION

Conventional golf balls are engineered according to aerodynamic specifications to perform in flight. These balls are not suitable for the terrain of the grass. No consideration has been given to make conventional golf balls truely putting compatible. Conventional balls are Aerodynamic and the improved putting golf ball, presented in this invention, is called "Terradynamic Ball". This invention provides a ball engineered primarily for putting and is accomplished by giving the ball more inertia and power and by decreasing friction and resistance in the roll. It is designed according to the laws of motion which states that, "Every body continues in its state of rest, or motion in a straight line, unless it is compelled by some external force to change that state".

There is a need for a ball designed to perform on the grass. Therefore, we are presenting in this invention, an improved golf ball structured primarily for putting, the "Terradynamic Ball".

To satisfy this need, an improved putting golf ball, comprising of two two basic features, which distinguish it from other conventional balls, is presented in this invention. It is engineered according to the Laws of Motion. First, it has a heavier core of metal. Thus, its mass or weight, is concentrated at its center. This mass creates greater inertia which, in turn, helps to maintain the rolling ball in a straight line. The greater the mass, the greater is the inertia.

The second unique feature or claim is that this ball rolls with less friction or resistance. The Law of Motion stated that a body would stay in line of direction unless it was opposed by an external force. The invention herewith, incorporates a "uniformly even and smooth" surface on the cover which minimizes resistance and friction to the rolling ball. This is in contrast to the cover of the conventional balls which are structured with dimples. These dimples interact with the grass and, accordingly, the ball is diverted as it rolls. The basic claims of this invention, are based on the embodiment of a heavy metal core and the smooth outer surface of the cover.

THE CORE. See Item 2, FIG. 1. The combination of concentrated weight at the core and a uniformly smooth surface of the cover, creates a controlable putting ball. Also, the concentration of greater weight in a small volume in the center of the ball, developes a lower center of gravity. The low center of mass at the core minimizes an upper torque effect. Consequently, the ball will not sway nor be prone to wobbling at the top from slight interferances. Of course, the main advantage of this core is its dynamics of inertia, as previously explained.

The heavy core, as a heavy metal can be made of steel or some other metal. The heavy core is a precision metal ball having a diameter measurement deviation from a target diameter of plus or minus 0.005" to 0.0001 and a sphericity deviation from a target roundness of plus or minus 0.005" to 0.000025". The precision metal ball is between ⅜ and 1¼" in diameter and weighs between 0.25 oz. and 4.5 oz.

The desired weight and inertia effect, can be accomplished by selecting the size of the steel core. Replacing the center of the ball by an equivalent volume of steel sphere, the weight of the ball will increase by the difference of the weight of the volume of material replaced and the weight of an equal volume of the spherical steel. Using the density, 0.6523 oz/in$^3$ of a conventional golf ball of 1.62 oz., the following weight increases are attained.

| | | | | | | | |
|---|---|---|---|---|---|---|---|
| Increase of Weight in oz. | 0.107 | 0.253 | 0.496 | 0.856 | 1.362 | 2.031 | 2.437 |
| Diameter of Steel Core, in. | 3/8 | 1/2 | 5/8 | 3/4 | 7/8 | 1.00 | 1 1/16 |

THE COVER, See Item 1, FIG. 1.

The outer surface of this putting golf ball, is uniformly even and smooth, thus enabling the ball to roll with less resistance and friction. The reason for this smooth surface on the cover, is to provide a freer roll over the grass.

The surfaces of conventional golf balls are sculptured with high and low patterns such as dimples, inorder to put the ball into flight and gain a great distance. Yet this same ball is used for driving off the tee as well as for putting on the grass. Conventional balls are engineered for qualities of their flight, distance, spin and so forth. They are great for all that and fun to "whack". But what about poor putting experience? No consideration has been given to make conventional balls truely putting efficient.

In using this "aerodynamic" ball on the "green" for putting, certain difficulties arise due to its light weight and the sculptured designs on the cover. While rolling, the blades of grass, in a minute way, snag the ball by interacting with the high and low reliefed designs on the surface of the ball's cover. The blades of grass catching on the edges of the dimple's high spots, have a tendency to significantly divert and detour the ball from its intended path. The player has no control or recourse to the interaction of the grass with the ball. Remember, these balls were designed to best fly through the air.

On the other hand, by utilizing a smooth surfaced ball, as claimed herin, there will be less interaction betweeen the grass and the surface of the ball. This "Terradynamic BAll" will have the advantage to roll and travel with less intereference, less resistance and less friction. The smooth surface will also have the advantage to compress the blades forward and down, enabling the ball to roll more freely without being diverted. Thus, the putt will be more commensurate with the player's skill.

MAKING THE GOLF BALLS CLAIMED HEREIN. These balls can be made utilizing the state of the art commonly used in the manufacture of golf balls. All the material needed is of common use in the trade. The exception is the steel ball used as the core, and which is available from stock at hardware supply houses.

| COMPONENT | MATERIAL |
|---|---|
| Core | Steel Ball, except as noted |
| Thick Layer | Polybutadiene |
| Cover (hard) | Ionomer Resin (Surlyn, ™) |
| Thin Cover (optional) | Soft Balata (rubber) |

ASSEMBLY OF THE BALL. The methods and equipment are common to the golf ball manufacturing trade, and basically employ Injection Molding or Compression Molding. Following is the general sequence of the assembly procedure.

1. CORE. The steel ball is first machine sandblasted to roughen its surface for the bonding of the surrounding layer. See Item 2, FIG. 1.

2. THICK LAYER. It is used in two balls. If the ball comprises a hard cover, then the layer is made to fit under the cover. When a cheaper ball is made by omitting the hard cover, then the "thick layer" comes up to full size of the ball and also serves as a cover. See Item 3, FIG. 1. For this cheap ball the layer material would be different, perhaps hard Balata.

To surround the core with the thick layer, there are two methods for molding. One is the injection method, which positions the core in the center by means of retractable pins. Then there is the compression molding which is more favorable. In this method, the layer is made in two hemispheres by injection molding. Then the two halves are placed around the core and placed in a in a compression mold under heat and compression so that all the pieces bond together. Thus the core is surrounded by the thick layer.

3. COVER (smooth): The cover is molded in two hemispheres by injection molding. The two halves then, are put around the layer assembly mentioned above. Then this partial assembly is placed in a compression mold and molded into a completed ball using heat and pressure. See Item 1, FIG. 1. The outer surface embodying a very high polished, minor finish and defined by the Society of Plastic Industry and the Society of Plastic Engineers as a SPI-SPE 1 finish.

Since one of the basic claims of this invention is a "uniformly even and smooth surface of the cover", the inner surfaces of the mold cavities will have to be smooth to accomplish a smooth cover. The inside surfaces of the cavities of molds for conventional balls, are sculptured to form dimples on the cover.

4. THIN COVER: Is accomplished as above cover (1). It is optional and is made of soft Balata to give softer feel at impact.

As previously stated, the fundamentals of this invention for an improved golf ball, structured primarily for putting, comprises 1, a heavy metal core, and 2, a uniformly even and smooth surface on the cover. This "Terradynamic Ball" is defined in claim 1.

Another version of the above ball, (cheaper) merely omits the hard cover and thus this thick layer, also serves as a cover. This will require that this "thick layer" be of harder material, such as hard Balata. The surface of this layer comprises a uniformly even and smooth surface.

Another embodiment of my invention includes having an additional cover over the existing cover to enable a softer "feel" at impact. This softer, additional cover, would be optional.

What is claimed is:

1. A putting golf ball consisting solely of:

a solid metal core with a diameter measurement deviation of said core from a target diameter of plus or minus 0.05" to 0.0001" and a sphericity deviation from a target roundness of plus or minus 0.05" to 0.000025", an inner cover encapsulating said metal core and a outer polished cover encapsulating said inner cover, said polished cover having smooth mirror finish equivalent to a SPI-SPE 1 finish on the outer layer.

2. The golf ball of claim 1 wherein said inner cover is composed of polybutadiene.

3. The golf ball of claim 1 wherein said metal core is selected from the group consisting of stainless steel, chrome steel, carbon steel, tungsten, copper, brass or metal alloy.

4. The golf ball of claim 1 wherein said metal core is between ⅜" and 1¼" in diameter.

5. The golf ball of claim 1 wherein said metal core weighs between 0.25 oz and 4.5 oz.

* * * * *